US009609426B2

(12) United States Patent
Akino

(10) Patent No.: US 9,609,426 B2
(45) Date of Patent: Mar. 28, 2017

(54) NARROW-ANGLE DIRECTIONAL MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/041,620

(22) Filed: Feb. 11, 2016

(65) Prior Publication Data

US 2016/0241952 A1 Aug. 18, 2016

(30) Foreign Application Priority Data

Feb. 17, 2015 (JP) ..... 2015-028654

(51) Int. Cl.
*H04R 9/08* (2006.01)
*H04R 1/34* (2006.01)

(52) U.S. Cl.
CPC ..... *H04R 1/342* (2013.01)

(58) Field of Classification Search
CPC . H04R 1/20; H04R 1/28; H04R 1/326; H04R 1/342; H04R 1/406; H04R 1/1041; H04R 25/48; H04R 25/65; H04R 25/604; H04R 2201/40
See application file for complete search history.

(56) References Cited

U.S. PATENT DOCUMENTS

2012/0263333 A1* 10/2012 Akino ..... H04R 1/025 381/356

FOREIGN PATENT DOCUMENTS

JP 2012-227600 A 11/2012

* cited by examiner

*Primary Examiner* — Brian Ensey
(74) *Attorney, Agent, or Firm* — Manabu Kanesaka

(57) ABSTRACT

An acoustic tube attaching unit that attaches an acoustic tube to a side of a main body case where a microphone unit is mounted. The acoustic tube attaching unit includes first and second elastic members lying between a fixing member and a washer, and bolts that tight the fixing member and the washer in an axial direction. A peripheral edge surface of the first elastic member is formed in a linear manner, and a peripheral edge surface of the second elastic member is formed in a recessed surface manner, so that the peripheral edge surface of the first elastic member protrudes in an outer peripheral direction by elastic deformation by the tightening of the bolts. The acoustic tube is attached to the main body case side by fixing action to an inner wall of the acoustic tube by the protrusion of the first elastic member in the outer peripheral direction.

10 Claims, 4 Drawing Sheets

NARROW-ANGLE DIRECTIONAL MICROPHONE

RELATED APPLICATIONS

The present application is based on, and claims priority from, Japanese Application No. JP2015-028654 filed Feb. 17, 2015 , the disclosure of which is hereby incorporated by reference herein in its entirety.

BACKGROUND OF THE INVENTION

Field of the Invention

The present invention relates to a narrow-angle directional microphone that allows an acoustic tube to be atachably/detachably mounted to a main body case that includes a microphone unit, and especially relates to a narrow-angle directional microphone with a devised attaching structure of the acoustic tube to the main body case.

Description of the Related Art

As a narrow-angle directional microphone, one using a long and narrow acoustic tube, and having a microphone unit arranged near a rear end portion of the acoustic tube in a length direction is known. This narrow-angle directional microphone has a characteristic to detect only a sound wave entering from a direction of a front end portion of the acoustic tube.

In the acoustic tube, the front end portion thereof is open, a slit-like sound wave introducing port is formed in a side wall, and an acoustic resistance material is affixed to the sound wave introducing port. Accordingly, regarding the sound waves from directions except the direction of the front end of the acoustic tube, the sound wave entering from the front end of the acoustic tube, and the sound wave entering through the sound wave introducing portion in the side wall of the acoustic tube have a time difference, thereby to interfere with each other and cancel each other.

Such a microphone is also called shotgun microphone, and is a narrow-angle directional microphone having high sensitivity to the sound wave from the direction of the front end portion of the acoustic tube.

According to the narrow-angle directional microphone including the acoustic tube, characteristics of narrow-angle directivity depend on the wavelength of the sound wave and the length of the acoustic tube. That is, when a long acoustic tube is used, the narrow-angle directivity can be obtained with frequencies up to a low frequency, and when a short acoustic tube is used, the narrow-angle directivity can be obtained only with a high frequency. To use the difference of the characteristics of depending on the length of the acoustic tube, a microphone that allows an acoustic tube to be attachable/detachable to/from a main body case in which a microphone unit is arranged, that is, a narrow-angle directional microphone that allows acoustic tubes having different axial lengths to be replaceable, as needed, has been proposed.

Conventionally, as means for attaching the acoustic tube to the main body case, means for attaching the acoustic tube with fixing screws in three places in a peripheral direction, for example, in a joint portion of a front end portion of the main body case with the acoustic tube, is typically employed.

FIGS. 4A and 4B and FIG. 5 of JP 2012-227600 A (hereinafter, called Patent Document 1) disclose the above-described means for attaching the acoustic tube with the fixing screws.

FIGS. 4A and 4B of the above-described application illustrate an example of attaching the acoustic tube to the main body case side using the fixing screws disclosed in Patent Document 1. Note that the example of FIGS. 4A and 4B illustrates a principal portion of a configuration in which the acoustic tube is attached to the main body case through a relay member mounted to the main body case, by enlarged sectional views.

The relay member 12 has a rear end portion to which a cylindrical main body case 11 is attached, and a front end portion side of the relay member 12 is reduced in an outer diameter, and a tip end portion of the front end portion side supports the microphone unit 1.

As illustrated in FIG. 4A, the microphone unit 1 includes a diaphragm 3 at a front end portion in a unit case 2, and a fixed electrode 4 facing a back surface of the diaphragm 3. Further, an electrode drawing part 5 is arranged on a back surface of the fixed electrode 4. An air chamber 6 communicating into the back surface of the diaphragm 3 is formed between the electrode drawing part 5 and the fixed electrode 4.

A sound hole 5*a* communicating into the air chamber 6 penetrates the electrode drawing part 5 in an axial direction and formed therein. An acoustic resistance body 7 formed in a doughnut shape is arranged on a back surface of the electrode drawing part 5, and blocks the sound hole 5*a*.

The acoustic resistance body 7 is sandwiched between an adjusting ring 8 arranged on a back surface of the acoustic resistance body 7 and the electrode drawing part 5, and the degree of compression of the acoustic resistance body 7 is adjustable. Accordingly, the acoustic resistance by the acoustic resistance body 7 is configured to be variable. Then, a sealing member 9 that blocks the back of the unit case 2 is attached to a back surface of the adjusting ring 8 with a small gap. Further, a base member 10 that supports the unit case 2 is attached to a rear end portion of the unit case 2, and an axial hole formed in a central portion of the base member 10 is fit into the tip end portion of the relay member 12. Then, a microphone unit 1 is held in the front end portion of the relay member 12.

An insulating base 13 is inserted into and arranged in the relay member 12. A drawing rod 14 that comes in contact with the electrode drawing part 5 is embedded in a central portion of the insulating base 13.

Although not illustrated, a circuit board on which an impedance conversion circuit and the like are mounted is arranged in the main body case 11 attached to the rear end portion of the relay member 12. Further, an output connector into which a microphone output is led is arranged in a rear end portion of the main body case 11, the microphone output having been signal-processed in the circuit board.

A ring-like step portion 12*a* is formed in the relay member 12. The external shape around a rear end portion of the step portion 12*a* is made slightly narrow. A rear end portion of a cylindrical acoustic tube 21 is attached to abut against the step portion 12*a*. Further, a sound conduction hole 21*a* is formed in a side wall of the acoustic tube 21, the side wall being adjacent to the unit case 2. A sound conduction hole 2*a* formed in the side wall of the unit case 2 communicates into an outside through the sound conduction hole 21*a*.

Therefore, the sound conduction hole 21*a* formed in the acoustic tube 21 functions as an acoustic taking-in hole of the microphone unit 1 at a rear portion side. Accordingly, the microphone unit 1 configures a unidirectional condenser microphone.

Then, a rear end portion of the acoustic tube 21 is attached to the relay member 12 with fixing screws 23 screwed into the relay member 12 at three places in the peripheral direction. Accordingly, the acoustic tube 21 and the main body case 11 are coaxially connected through the relay member 12 in a front and rear direction.

By the way, the entire length of the narrow-angle directional microphone is long. Therefore, the narrow-angle directional microphone has a problem of being easily damaged when stress is applied to the relay member 12 that is a joint portion of the acoustic tube. Especially, as illustrated in FIG. 4B, in a case where the acoustic tube 21 is attached to the relay member 12 using the fixing screws 23, and when bending stress acts on the acoustic tube 21, a screw insertion hole 21*b* at the acoustic tube 21 side is deformed. Accordingly, a problem that a gap is caused between the screw insertion hole 21*b* and the fixing screw 23 in an axial direction, and the fixing screw 23 is loosened is caused. The looseness of the fixing screw 23 caused as described above becomes a cause of occurrence of noises during the use of the microphone.

Especially, in this sort of microphones, a microphone unit with a large effective area needs to be mounted in order to improve the sensitivity and a signal-to-noise ratio. Further, the thickness of a tube wall of the acoustic tube 21 is required to become as thin as possible in order to decrease the weight of the entire microphone. Due to the above reasons, mechanical strength of the acoustic tube 21 is further decreased, and the above-described problem becomes more prominent.

Note that the configuration of the microphone 1 illustrated in FIG. 4B is the same as the one illustrated in FIG. 4A. Therefore, description of the reference numerals of the respective units that configure the microphone unit 1 is omitted in FIG. 4B.

SUMMARY OF THE INVENTION

The present invention has been made in view of the above-described problem in the conventional narrow-angle directional microphone to which the acoustic tube is attached with the fixing screws, and an objective is to provide a narrow-angle directional microphone that is less likely to be damaged even if bending stress is applied to the microphone, and enables easy attachment/detachment of the acoustic tube.

A narrow-angle directional microphone according to the present invention has been made in order to solve the above-described problem, and the narrow-angle directional microphone includes: an acoustic tube; and an acoustic tube attaching unit configured to attachably/detachably attach the acoustic tube, wherein the acoustic tube attaching unit includes a first elastic member lying between a fixing member and a washer, and having a peripheral edge surface formed in a linear manner, and a bolt that tights the fixing member and the washer in an axial direction, and the first elastic member is deformed by tightening of the bolt and compression by the fixing member and the washer, and abuts against an inner wall of the acoustic tube.

In this case, favorably, it is configured that a ring-like recessed portion is formed in the inner wall of the acoustic tube, the peripheral edge surface of the first elastic member is deformed and protrudes in an outer peripheral direction with the tightening of the bolt, and the protrusion of the first elastic member abuts against the ring-like recessed portion.

Then, favorably, a ring-like step portion is included in the acoustic tube attaching unit.

Further, it is desirable that the acoustic tube attaching unit further includes a second elastic member having a peripheral edge surface formed in a recessed surface manner, and the second elastic member is arranged between the fixing member and the washer together with the first elastic member.

In this case, it is configured that the peripheral edge surface of the second elastic member is deformed by the tightening of the bolt and abuts against the inner wall of the acoustic tube.

Further, it is configured that the washer retracts the first elastic member in the axial direction by tightening of the bolt, and the protrusion of the first elastic member holds the acoustic tube by pulling the ring-like recessed portion rearward in the axial direction, using the ring-like step portion as a support point, and having the ring-like recessed portion pressed against the ring-like step portion.

Further, in a favorable form, it is configured that a rear end portion of the acoustic tube abuts against the ring-like step portion to configure the support point.

In addition, a configuration that a plurality of the bolts is included to penetrate the washer, the first elastic member, the second elastic member, and the fixing member, and the plurality of bolts is arranged at equal intervals in a peripheral direction can be favorably employed.

Further, one or both of the first elastic member and the second elastic member have conductivity.

According to the narrow-angle directional microphone according to the present invention, by the tightening of the bolts arranged in the acoustic tube attaching unit, the peripheral edge surface of the first elastic member protrudes in the outer peripheral direction by the elastic deformation. Accordingly, the peripheral edge surface of the first elastic member is fixed to the inner wall of the acoustic tube with pressure, and the acoustic tube can be attached to the main body case side.

With the tightening of the bolts, the first and second elastic members are compressed in the axial direction. The peripheral edge surface of the first elastic member, which protrudes in the outer peripheral direction, is slightly retracted in the axial direction. Therefore, the ring-like recessed portion into which the peripheral edge surface of the first elastic member, which protrudes in the outer peripheral direction, enters is formed in the inner wall surface of the acoustic tube, so that the peripheral edge surface of the first elastic member is slightly retracted while protruding toward the recessed portion with the tightening of the bolts. Therefore, the acoustic tube can be mounted to the main body case side without a gap.

Further, the acoustic tube can be detached by cancelling the tightening of the bolts. Therefore, replacement work of the acoustic tube is easy. Further, the acoustic tube is held by elastic deformation of the first elastic member. Therefore, unique function and effect to be less likely to be damaged even if bending stress is applied to the microphone can be obtained.

DESCRIPTION OF THE PREFERRED EMBODIMENTS

Figure 1A:
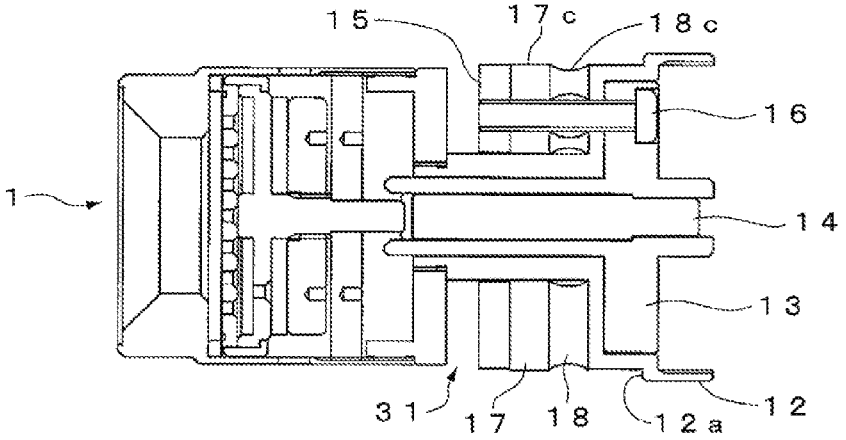
FIG. 1A is a sectional view illustrating a microphone unit and an acoustic tube attaching unit in a narrow-angle directional microphone according to the present invention.

A narrow-angle directional microphone according to the present invention will be described based on embodiments illustrated in the drawings. Note that a configuration of a microphone unit included in the narrow-angle directional microphone described below is the same as the configuration of the microphone unit 1 described based on FIGS. 4A and 4B. Therefore, in the drawings described below, the entire microphone unit is denoted with the reference sign 1, and description of the reference signs of respective units of the microphone unit and detailed description thereof are omitted.

Figure 1B:
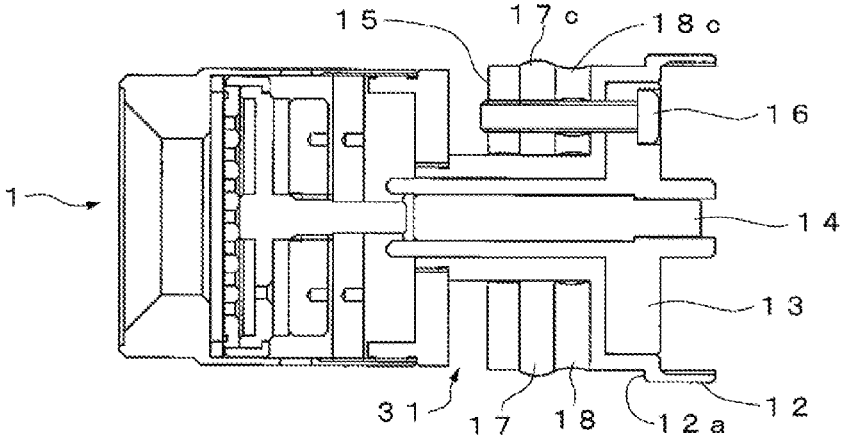
FIG. 1B is a sectional view illustrating a state in which a bolt is tightened to FIG. 1A.
Figure 1C:
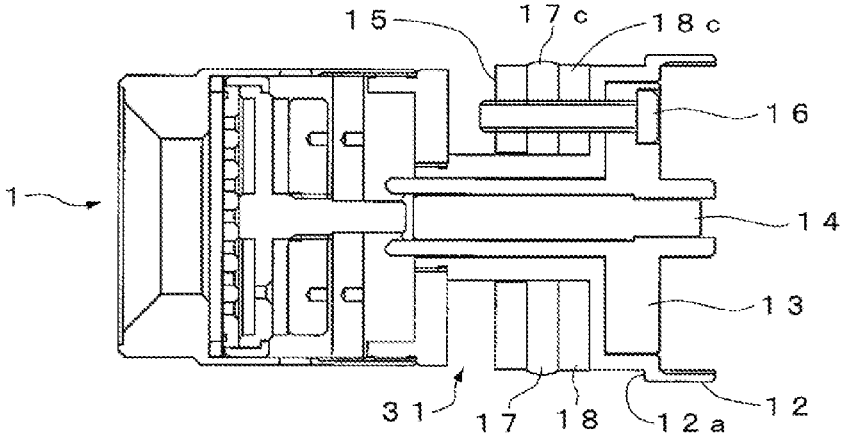
FIG. 1C is a sectional view illustrating a state in which the bolt is further tightened to FIG. 1B.
Figure 4A:
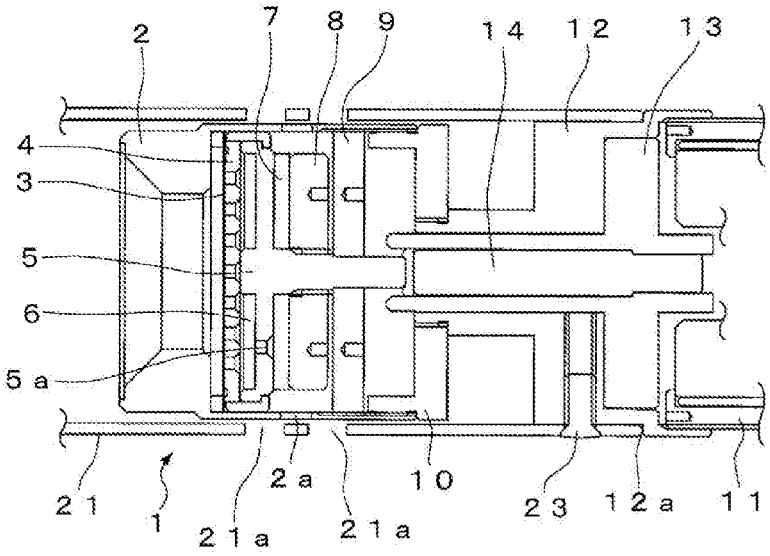
Fig. 4A Prior Art
FIG. 4A is a sectional view illustrating an example of a conventional narrow-angle directional microphone.
Figure 4B:
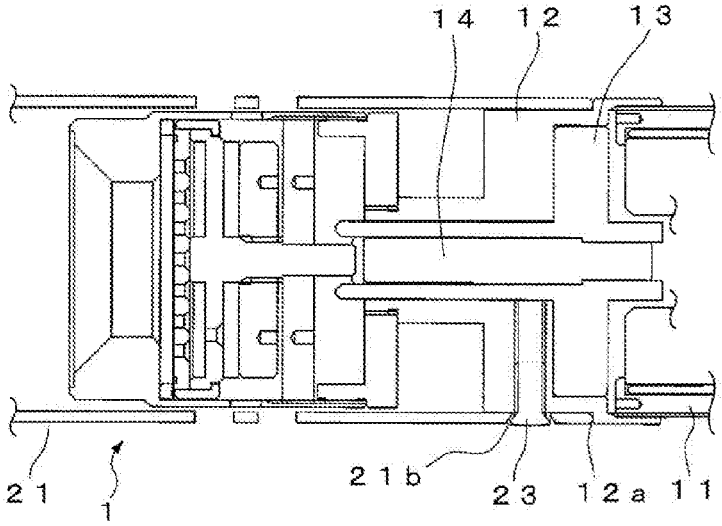
Fig. 4B Prior Art
FIG. 4B is a sectional view illustrating an example in which failure is caused in the narrow-angle directional microphone illustrated in FIG. 4A.

FIGS. 1A to 1C are sectional views illustrating a configuration of an acoustic tube attaching unit 31 arranged on a back surface side of the microphone unit 1. In the acoustic tube attaching unit 31, a relay member 12, an insulating base 13, and a drawing rod 14 described based on FIGS. 4A and 4B are used as a part of configuration elements. Then, similarly to the example illustrated in FIGS. 4A and 4B, a main body case 11 is attached to a rear end portion of the relay member 12, but illustration of the main body case 11 is omitted in FIGS. 1A to 1C. That is, the acoustic tube attaching unit 31 described below configures a part of the main body case 11.

As illustrated in FIGS. 1A to 1C, a doughnut-like washer 15 is mounted on a portion of the relay member 12 at the front end portion side, where an outer diameter is reduced. Then, a tip end portion of a bolt 16 inserted from a rear surface side of the insulating base 13 as a fixing member is screwed into the washer 15. Note that, in this example, three bolts including the illustrated bolt 16 are arranged at equal intervals in a peripheral direction.

Figure 2A:
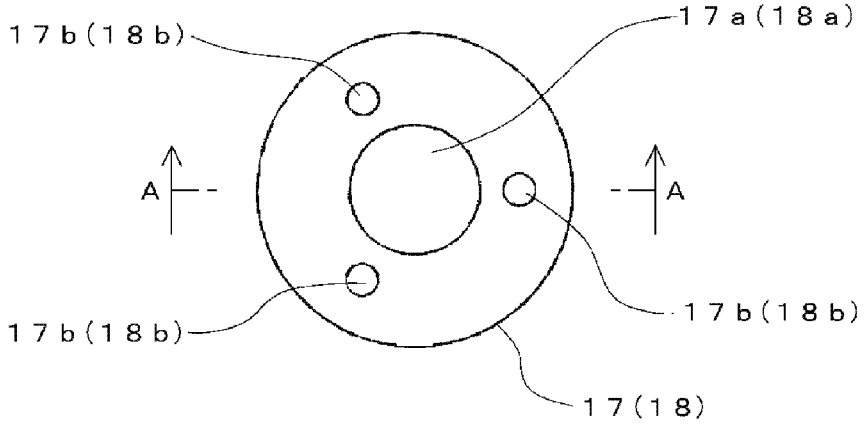
FIG. 2A is a front view of a first elastic member or a second elastic member.
Figure 2B:
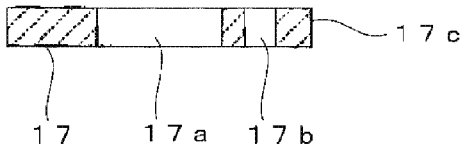
FIG. 2B is a sectional view of the first elastic member as viewed from the A-A line of FIG. 2A in the arrow direction.
Figure 2C:
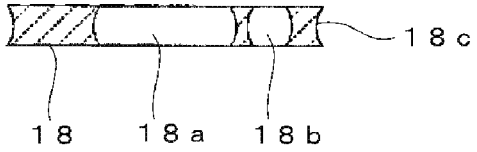
FIG. 2C is a sectional view of the second elastic member as viewed from the A-A line of FIG. 2A in the arrow direction.

A first elastic member 17 and a second elastic member 18 are mounted between the insulating base 13 as the fixing member and the washer 15. Note that, hereinafter, the insulating base 13 is also called fixing member. Rubber material formed into a disk shape having a predetermined thickness (thickness) is used for the first and second elastic members 17 and 18, as illustrated in FIGS. 2A to 2C. Holes 17*a* and 18*a* having a relatively large diameter are formed in a central portion of the disk-like rubber material. That is, the first and second elastic members 17 and 18 are configured from doughnut-like rubber material. Further, three bolt insertion holes 17*b* and 18*b* into which the bolts 16 are inserted are formed in the first and second elastic members 17 and 18 at equal intervals in the peripheral direction.

A peripheral edge surface 17*c* of the first elastic member 17 is linearly formed, as illustrated in the sectional view of FIG. 2B.

Meanwhile, a peripheral edge surface 18*c* of the second elastic member 18 is formed in a recessed surface manner, as illustrated in the sectional view of FIG. 2C. That is, the peripheral edge surface 18*c* of the second elastic member 18 is formed in a recessed state toward a center in a radius direction (a state where a central portion in a thickness direction is recessed). This is formed such that plate-like rubber material is processed in a compressed state in the thickness direction, in forming the second elastic member 18. That is, cutting of the peripheral edge surface 18*c*, and punching of the central holes 18*a* and the bolt insertion holes 18*b* are performed at the same time, so that the second elastic member in a recessed state toward the center in the radius direction, as illustrated in FIG. 2C, is formed.

Then, in this embodiment, the plate-like rubber material formed to have approximately the same thickness is used for the first and second elastic members 17 and 18.

FIG. 1A illustrates a state before the bolt 16 is tightened. In this state, the first and second elastic members 17 and 18 lying between the fixing member 13 and the washer 15 hold a state of the original form without being subject to elastic deformation.

Further, FIG. 1B illustrates a state where the bolt 16 is slightly tightened. According to this state, the washer 15 is slightly moved to the fixing member 13 side, and compresses the first and second elastic members 17 and 18 in an axial direction. Therefore, the first elastic member 17 is subject to the elastic deformation, and the peripheral edge surface 17*c* slightly protrudes in an outer peripheral direction. Meanwhile, the second elastic member 18 is subject to the elastic deformation and expands in the outer peripheral direction, and the degree of the recess of the peripheral edge surface 18*c* becomes moderate.

FIG. 1C illustrates a state in which the bolt 16 is further tightened. According to FIG. 1C, the washer 15 is further moved to the fixing member 13 side, and further compresses the first and second elastic members 17 and 18 in the axial direction. Therefore, the peripheral edge surface 17*c* of the first elastic member 17 further protrudes in the outer peripheral direction, and the peripheral edge surface 18*c* of the second elastic member 18 is deformed to become nearly a linear state along the axial direction.

Figure 3A:
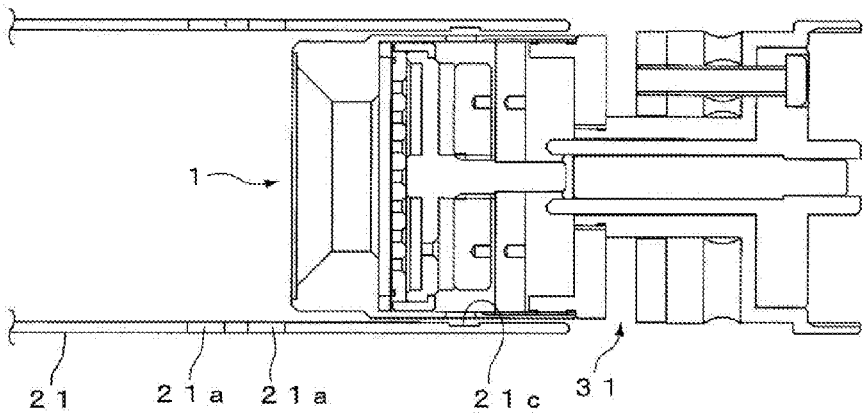
FIG. 3A is a sectional view illustrating a state of in the process of mounting an acoustic tube to the acoustic tube attaching unit illustrated in FIG. 1A.
Figure 3B:
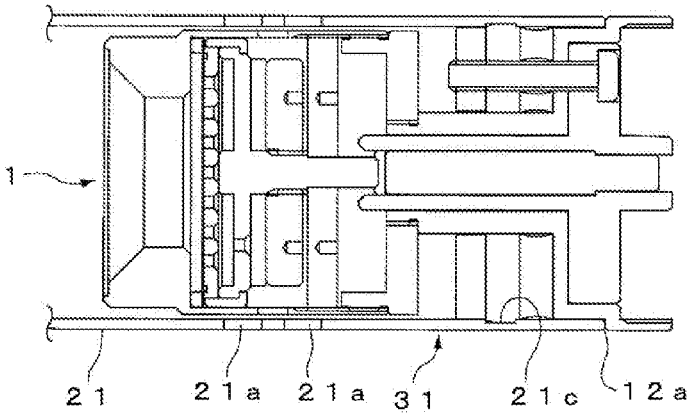
FIG. 3B is a sectional view illustrating a state in which the acoustic tube is mounted and the bolt is tightened.
Figure 3C:
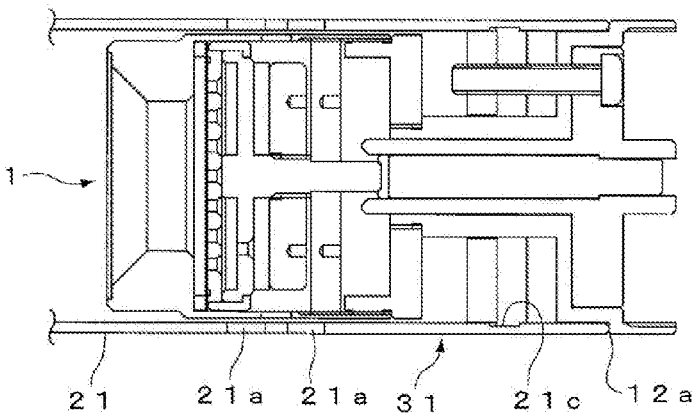
FIG. 3C is a sectional view illustrating a state in which the bolt is further tightened to FIG. 3B.

FIGS. 3A to 3C illustrate an example of attaching the cylindrical acoustic tube 21 to the main body case 11, using the above-described action of the acoustic tube attaching unit 31. Note that respective states of the acoustic tube attaching unit 31 illustrated in FIGS. 3A to 3C indicate the same states of the acoustic tube attaching unit 31 illustrated in FIGS. 1A to 1C. Therefore, in FIGS. 3A to 3C, the reference signs of the respective units that configure the acoustic tube attaching unit 31 are omitted.

Further, the main body case 11 is attached to a rear portion of the acoustic tube attaching unit 31 in FIGS. 3A to 3C, similarly to the example illustrated in FIGS. 4A and 4B. However, illustration of the main body case 11 is omitted in FIGS. 3A to 3C.

FIG. 3A illustrates a state of attaching the acoustic tube 21 to the acoustic tube attaching unit 31. The acoustic tube 21 is mounted from the front of the main body case 11 to cover the microphone unit 1. A ring-like recessed portion 21*c* is formed in the acoustic tube 21 used in this example, along an inner wall surface near a rear end portion of the acoustic tube 21.

Then, in the state illustrated in FIG. 3A, the first and second elastic members 17 and 18 that configure the acoustic tube attaching unit 31 holds the state of the original form without being subject to the elastic deformation. Therefore, the acoustic tube 21 can be mounted to the main body case 11 to cover the acoustic tube attaching unit 31 from an outside without resistance.

In the above state, the bolts 16 of the acoustic tube attaching unit 31 are tightened, so that the peripheral edge surface 17*c* of the first elastic member 17 enters the ring-like recessed portion 21*c* formed along the inner wall surface of the acoustic tube 21 and is fixed with pressure, as illustrated in FIG. 3B.

The bolts 16 are further tightened, so that the first and second elastic members 17 and 18 are subject to compression in the axial direction, and are moved (retracted) to the fixing member 13 side. At this time, the peripheral edge surface 17*c* of the first elastic member 17, which protrudes in the outer peripheral direction, is moved (retracted) to the fixing member 13 side in a state of being fit into the ring-like recessed portion 21*c*. Further, the peripheral edge surface 18*c* of the second elastic member 18 abuts against the inner wall of the acoustic tube with certain friction force.

Accordingly, as illustrated in FIG. 3C, the peripheral edge surface 17*c* of the first elastic member 17 applies tensile stress to the ring-like recessed portion 21*c* of the acoustic tube 21 in the axial direction. That is, the peripheral edge surface 17*c* retracts the ring-like recessed portion 21*c* in the axial direction, and acts to pull the acoustic tube 21, using the ring-like step portion 12*a* of the relay member as a support point. The rear end portion of the acoustic tube 21 is pressed against the ring-like step portion 12*a* of the relay member by the peripheral edge surface 17*c* through the ring-like recessed portion 21*c*. Therefore, the rear end portion of the acoustic tube 21 abuts against the ring-like step portion 12*a* of the relay member without any gap, and the acoustic tube 21 is attached by the acoustic tube attaching unit 31.

Further, the peripheral edge surface 18*c* of the second elastic member 18 abuts against the inner wall of the acoustic tube 21 with certain friction force. Therefore, the friction force of the peripheral edge surface 18*c* of the second elastic member 18 acts to support holding power by the peripheral edge surface 17*c* of the first elastic member 17 and the ring-like recessed portion 21*c*, thereby to enhance the holding power of the acoustic tube.

According to the above-described embodiment, the bolts 16 are loosened and the state is returned to the state illustrated in FIG. 3A, so that the acoustic tube 21 can be easily detached. Therefore, the present embodiment can be favorably employed for a narrow-angle directional microphone that allows acoustic tubes having different axial lengths to be replaceable, as described in the beginning of the specification, and the function and effect as described in SUMMARY OF THE INVENTION can be obtained.

Note that, as the material of the first and second elastic members 17 and 18, plate-like conductive elastomer may be employed. When the first and second elastic members 17 and 18 are configured from the conductive elastomer, the metal-made acoustic tube 21 and the acoustic tube attaching unit 31 are electrically connected. As a result, the conductive elastomer-made first and second elastic members 17 and 18 have an effect to electrically shield surroundings of the microphone unit 1.

What is claimed is:

1. A narrow-angle directional microphone comprising:

an acoustic tube; and an acoustic tube attaching unit configured to atachably/detachably attach the acoustic tube, wherein the acoustic tube attaching unit includes a first elastic member lying between a fixing member and a washer, and having a peripheral edge surface formed in a linear manner, and a bolt that tights the fixing member and the washer in an axial direction, and the first elastic member is deformed by tightening of the bolt and compression by the fixing member and the washer, and abuts against an inner wall of the acoustic tube.

2. The narrow-angle directional microphone according to claim 1, wherein a ring-like recessed portion is formed in the inner wall of the acoustic tube, the peripheral edge surface of the first elastic member is deformed and protrudes in an outer peripheral direction with the tightening of the bolt, and the protrusion of the first elastic member is fit in the ring-like recessed portion.

3. The narrow-angle directional microphone according to claim 2, wherein the acoustic tube attaching unit includes a ring-like step portion.

4. The narrow-angle directional microphone according to claim 1, wherein the acoustic tube attaching unit further includes a second elastic member having a peripheral edge surface formed in a recessed surface manner, and the second elastic member is arranged between the fixing member and the washer together with the first elastic member.

5. The narrow-angle directional microphone according to claim 4, wherein the peripheral edge surface of the second elastic member is deformed by the tightening of the bolt and abuts against the inner wall of the acoustic tube.

6. The narrow-angle directional microphone according to claim 3, wherein the washer retracts the first elastic member in the axial direction by tightening of the bolt, and the protrusion of the first elastic member holds the acoustic tube by pulling the ring-like recessed portion rearward in the axial direction, using the ring-like step portion as a support point, and having the ring-like recessed portion pressed against the ring-like step portion.

7. The narrow-angle directional microphone according to claim 6, wherein a rear end portion of the acoustic tube abuts against the ring-like step portion to configure the support point.

8. The narrow-angle directional microphone according to claim 4, wherein a plurality of the bolts is included to penetrate the washer, the first elastic member, the second elastic member, and the fixing member, and the plurality of bolts is arranged at equal intervals in a peripheral direction.

9. The narrow-angle directional microphone according to claim 1, wherein the first elastic member has conductivity.

10. The narrow-angle directional microphone according to claim 4, wherein the second elastic member has conductivity.

* * * * *